US007388326B2

(12) United States Patent
Ryu

(10) Patent No.: US 7,388,326 B2
(45) Date of Patent: Jun. 17, 2008

(54) ELECTRON EMISSION DEVICE HAVING A NOVEL ELECTRON EMISSION REGION DESIGN

(75) Inventor: Kyung-Sun Ryu, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 527 days.

(21) Appl. No.: 11/060,493

(22) Filed: Feb. 18, 2005

(65) Prior Publication Data

US 2005/0184645 A1 Aug. 25, 2005

(30) Foreign Application Priority Data

Feb. 20, 2004 (KR) ..... 10-2004-0011391

(51) Int. Cl.
*H01J 1/62* (2006.01)
*H01J 63/04* (2006.01)

(52) U.S. Cl. ..... 313/497; 313/495

(58) Field of Classification Search ..... 313/495–497, 313/309, 311, 306, 331, 351; 445/23–25
See application file for complete search history.

(56) References Cited

U.S. PATENT DOCUMENTS 5,604,401 A * 2/1997 Makishima ..... 315/3
5,894,189 A * 4/1999 Ogasawara et al. ..... 313/310
6,946,800 B2 * 9/2005 Takeuchi et al. ..... 315/169.3

* cited by examiner

*Primary Examiner*—Joseph L Williams
(74) *Attorney, Agent, or Firm*—Robert E. Bushnell, Esq.

(57) ABSTRACT

A structure for a field emission device and a method of making the same. The cathode electrodes are formed as a two-layered structure of chromium on top of aluminum. Photosensitive electron emission material is patterned via back side exposing, the aluminum layer serving as a mask. In receptor regions, conducting aluminum fingers form electrical contact with the emission material while spaces between the aluminum fingers serve as a window to allow for exposure of the photosensitive emission material.

18 Claims, 10 Drawing Sheets

ELECTRON EMISSION DEVICE HAVING A NOVEL ELECTRON EMISSION REGION DESIGN

CLAIM OF PRIORITY

This application makes reference to, incorporates the same herein, and claims all benefits accruing under 35 U.S.C. §119 from an application for FIELD EMISSION DISPLAY DEVICE AND MANUFACTURING METHOD OF THE SAME earlier filed in the Korean Intellectual Property Office on 20 Feb. 2004 and there duly assigned Ser. No. 10-2004-0011391.

BACKGROUND OF THE INVENTION

1. Technical Field

The present invention relates to an electron emission device, and in particular, to an electron emission region and a method of manufacturing the same.

2. Description of the Related Art

Generally, the electron emission devices are classified into a first type where a hot cathode is used as an electron emission source, and a second type where a cold cathode is used as the electron emission source. The second type of electron emission devices include a field emitter array (FEA) type, a surface conduction emitter (SCE) type, a metal-insulator-metal (MIM) type, a metal-insulator-semiconductor (MIS) type, and a ballistic electron surface emitting (BSE) type.

The electron emission devices differentiate in their specific structure depending upon the types thereof, but basically have an electron emission unit placed within a vacuum vessel to emit electrons, and an image display unit facing the electron emission unit in the vacuum vessel to emit light or display the desired images.

With the FEA type electron emission device, electrons are emitted from electron emission regions due to the electric fields formed when driving voltages are applied to the driving electrodes placed around the electron emission regions. The FEA type electron emission device has a triode structure with cathode, gate and anode electrodes. The gate electrodes are first formed on a first substrate, and after an insulating layer is formed on the gate electrodes, cathode electrodes and electron emission regions are formed on the insulating layer.

With the above structure, there is no possibility that the gate and the cathode electrodes are short-circuited to each other during the processing thereof. As the electron emission regions are placed at the topmost area of the first substrate, a thick filming process, such as screen printing, can be easily applied thereto. The relatively simple processing steps related thereto are advantageous in making wide-screened display devices.

With the above-structured electron emission device, the electron emission regions are patterned by coating a photosensitive electron emission material onto the first substrate, and exposing it to light, followed by developing it. When ultraviolet rays are illuminate the electron emission material from the front side of the first substrate during the light-exposing step, the pattern of the electron emission regions is non-uniformly made, and the adhesion of the electron emission regions to the cathode electrodes is poor.

Accordingly, a backside exposure technique where the illumination of ultraviolet rays is made from the back side of the first substrate has been recently applied for the light exposing. However, a structure produced by such a method results in a high contact resistance between the electron emission regions and the cathode electrodes, a large voltage drop across the cathode electrodes and cracks in the insulation layer formed between the cathode and gate electrodes. All of these problems result in deteriorated image quality. What is needed is a design for a field emission device and a method of making that overcomes the above problems.

SUMMARY OF THE INVENTION

It is therefore an object to provide an improved design for a field emission device.

It is also an object of the present invention to provide a method for making the field emission device.

It is yet another object of the present invention to provide an electron emission device and a method of manufacturing the same using a backside exposure technique resulting in a device with enhanced device performance characteristics.

These and other objects may be achieved by a novel structure for a field emission device and a novel method of making the same. The cathode electrodes are formed as a two-layered structure of chromium on top of aluminum. Photosensitive electron emission material is patterned via back side exposing, the aluminum layer serving as a mask. In receptor regions, conducting aluminum fingers form electrical contact with the emission material while spaces between the aluminum fingers serve as a window to allow for exposure of the photosensitive emission material.

The electron emission device with the following features. The electron emission device includes first and second substrates facing each other, gate electrodes formed on the first substrate, and a metallic layer formed over the gate electrodes with an insulating layer sandwiched in between. The metallic layer has light transmission portions. Cathode electrodes are formed on the metallic layer while being electrically connected to the metallic layer. Electron emission regions are placed within the area of the light transmission portions while being electrically connected to the metallic layer.

The electron emission regions maybe electrically connected to the cathode electrodes. The light transmission portions may be formed with minute holes partially formed at the metallic layer. The minute holes may be formed with a rectangular, circular, triangular or hexagonal dot type. The minute holes may be vertically or horizontally elongated with a linear shape. The light transmission portions may be formed with a mesh pattern.

The light transmission portions and the electron emission regions may be formed at one side of the metallic layer and the cathode electrode in the longitudinal direction of the cathode electrode. The cathode electrode may have electron emission region receptors formed by partially removing the cathode electrode. The electron emission region receptor may be formed at the cathode electrode corresponding to the pixel region where the cathode electrode crosses the gate electrode. The metallic layer and the cathode electrode maybe formed with different kinds of metallic materials having etching selectivity.

The electron emission device may further include counter electrodes arranged on the insulating layer and spaced apart from the electron emission regions with a distance while being electrically connected to the gate electrodes. An electric field reinforcing hole maybe formed at the metallic layer and the cathode electrode opposite to the counter electrode with respect to the electron emission region while being spaced apart from the electron emission region by a distance by removing a part of the metallic layer and the cathode electrode and exposing the gate electrode.

In a method of manufacturing the electron emission device, gate electrodes are first formed on a first substrate using a transparent conductive material. A transparent dielectric material is then coated onto the first substrate covering the gate electrodes to form an insulating layer thereon. A metallic layer for forming subsidiary cathode electrodes and a metallic layer for forming cathode electrodes are sequentially deposited on the insulating layer. The cathode electrode metallic layer is patterned while exposing the underlying subsidiary cathode electrode metallic layer to form cathode electrodes. The subsidiary cathode electrode metallic layer is patterned to partially form light transmission portions thereon. A photosensitive electron emission material is coated onto the first substrate such that the photosensitive electron emission material is placed within the area of the light transmission portions. The photosensitive electron emission material is exposed by light from the opposite side of the first substrate, and the light-exposed electron emission material is developed to form electron emission regions electrically connected to the subsidiary cathode electrode metallic layer. The subsidiary cathode electrode metallic layer is partially removed while exposing the insulating layer. The degree of light exposure for the photosensitive electron emission material may be controlled such that the photosensitive electron emission material is placed on the subsidiary cathode electrode metallic layer, and electrically connected to the cathode electrodes.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
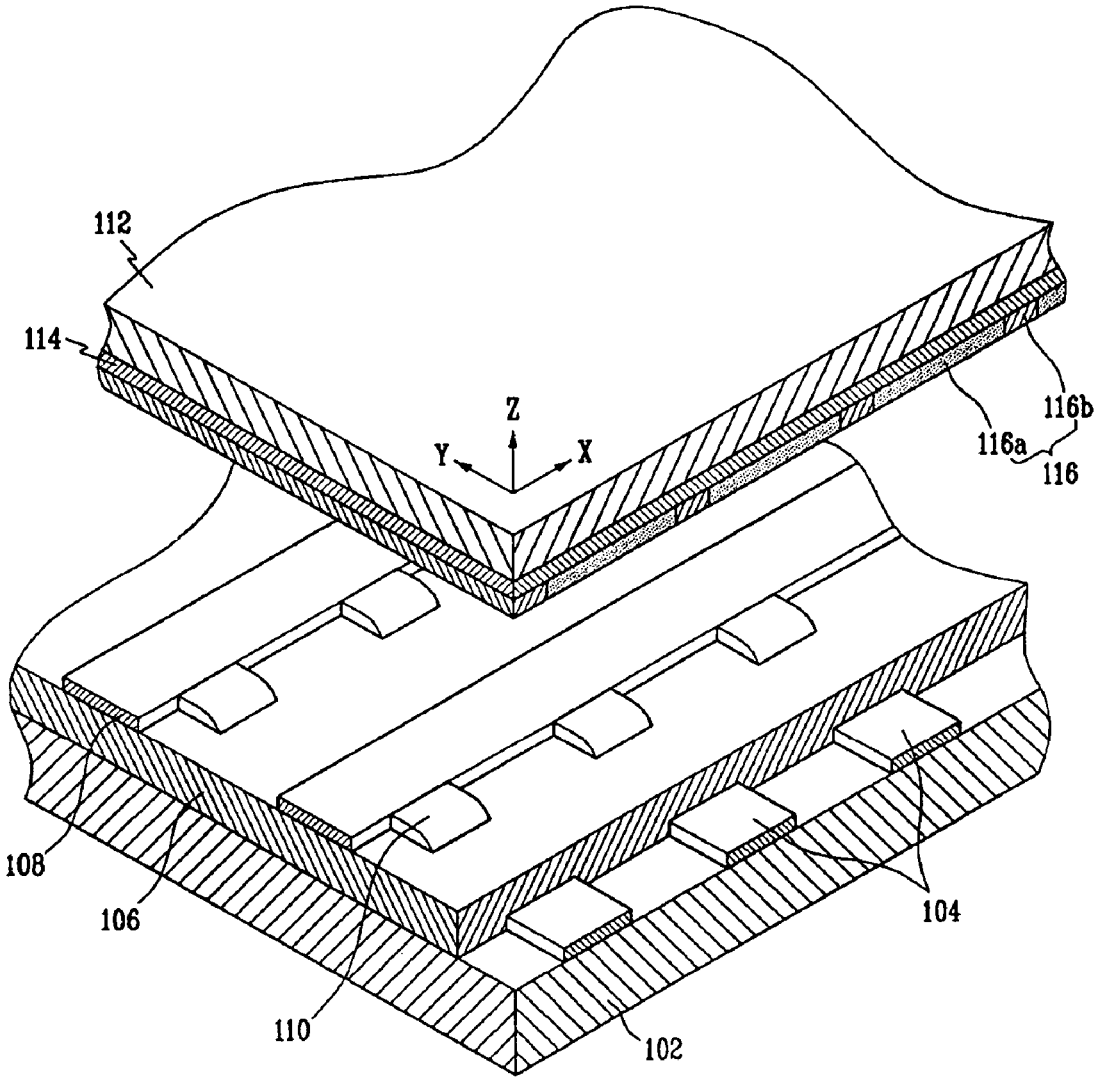
FIG. 1 is a partial exploded perspective view of an electron emission device.

An electron emission device where the electron emission regions are made using the backside exposure technique is illustrated in FIG. 1. As illustrated in FIG. 1, transparent gate electrodes 104 are formed on a first transparent substrate 102. An insulating layer 106 is formed on the entire inner surface of the first substrate 102 using a transparent material such that it covers the gate electrodes 104. Cathode electrodes 108 are formed on the insulating layer 106 by coating a metallic material, such as chromium Cr, thereon, and patterning it.

Electron emission regions 110 are formed at the lateral side of the respective cathode electrodes 108 by coating a carbonaceous and/or nano-sized electron emission material on the insulating layer 106, and exposing it to light using the backside exposure technique. Specifically, the formation of the electron emission regions 110 is made by first forming a sacrificial layer (not illustrated) on the cathode electrodes 108 and on the insulating layer 106. The sacrificial layer is patterned to open the locations to be formed with the electron emission regions 110. A photosensitive electron emission material is coated onto the sacrificial layer, and ultraviolet rays are illuminated thereon through the backside of the first substrate 102, followed by developing the exposed photosensitive electron emission material by removing the non-hardened electron emission material.

An anode electrode 114 is formed on the inner surface of the second substrate 112 facing the first substrate 102, and a phosphor screen 116 is formed on the anode electrode 114 with red, green and blue phosphor layers 116*a* and black layers 116*b*.

With the above structured electron emission device, as the backside exposure technique is used to process the electron emission material, a separate mask is not required, and as the cross-linking of the photosensitive material due to the ultraviolet light is made from the bottom of the electron emission regions, the risk of detachment of the electron emission material during the developing is decreased.

However, the electron emission regions left over after the developing contact the cathode electrodes only at the lateral side thereof, and after the surface-treatment for enhancing the electron emission, the contact area between the electron emission regions and the cathode electrodes is further reduced. Accordingly, the resulting electron emission device involves increased contact resistance between the electron emission regions and the cathode electrodes, uneven electron emission, and increased driving voltage. In a serious case, the electron emission regions and the cathode electrodes may be electrically short-circuited with each other.

Furthermore, when the chromium-based layer for forming the cathode electrodes are patterned using an etchant, the insulating layer is liable to be damaged due to the chromium etchant while generating cracks at the surface of the insulating layer. As a result, electron emission material is left over at the cracks of the insulating layer, and unnecessary diode light emission is made during the driving of the display device, thus deteriorating the screen image quality.

In addition, chromium has a lower conductivity compared to other electrode materials, such as aluminum, and a voltage drop is likely to occur along and across the cathode electrodes, especially in a wide-screened display device. In this case, the amount of electrons emitted from the electron emission regions is decreased due to the voltage drop along the cathode electrodes so that the screen brightness is lowered, and the driving voltage is heightened.

Figure 2:
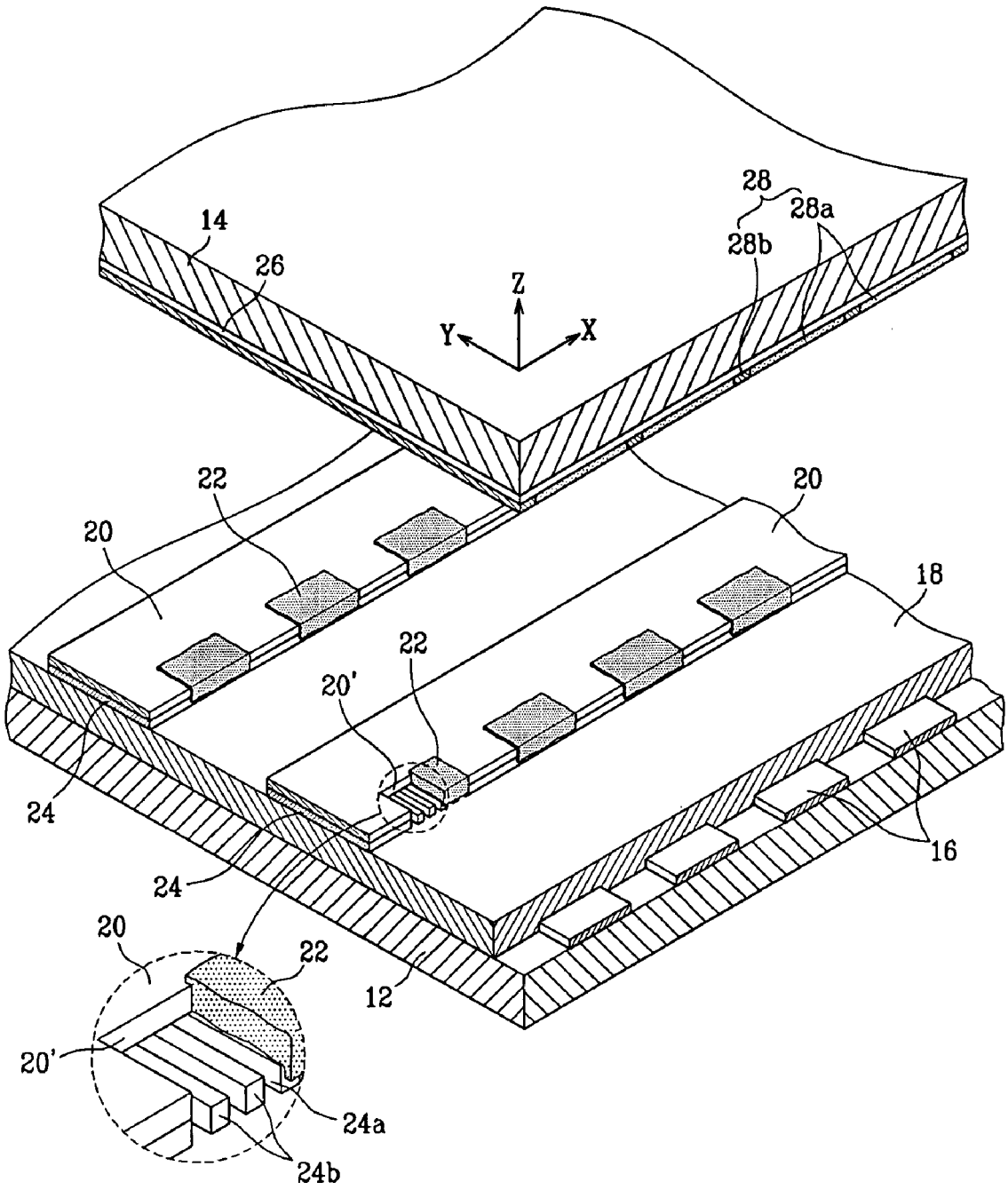
FIG. 2 is a partial exploded perspective view of an electron emission device according to an embodiment of the present invention.

Turning now to FIG. 2, FIG. 2 is a partial exploded perspective view of an electron emission device according to an embodiment of the present invention. As illustrated in FIG. 2, the electron emission device includes first and second substrates 12 and 14 facing each other. The first and the second substrates 12 and 14 are attached to each other at their periphery with a sealant (ex. frit), thus forming a vacuum vessel. An electron emission structure is provided at the first substrate 12 to emit electrons, and a light emission or display structure at the second substrate 14 to emit visible rays and display the desired images.

Specifically, gate electrodes 16 are formed on the first substrate 12 with a stripe pattern while proceeding in a direction (in the Y direction of the drawing). An insulating layer 18 is formed on the entire inner surface of the first substrate 12 covering the gate electrodes 16. Cathode electrodes 20 are formed on the insulating layer 18 and proceed in the direction crossing the gate electrodes 16 (in the X direction of the drawing). Receptors 20' are formed at the cathode electrodes 20, and electron emission regions 22 are placed within the receptors 20' of the cathode electrodes 20. The receptors 20' are formed by removing a part of the cathode electrode 20.

The gate electrodes 16 are formed with a transparent conductive material, such as indium tin oxide (ITO), and the insulating layer 18 with a transparent dielectric material. The electron emission regions 22 may be stripe-patterned along the cathode electrodes 20, or arranged at the pixel regions where the gate and the cathode electrodes 16 and 20 cross each other. The electron emission regions 22 are formed with a carbonaceous material, such as carbon nanotube, graphite, diamond, diamond-like carbon, C60 (fulleren), or a combination thereof. The electron emission regions 22 may be formed with a nanometer-sized material, such as carbon nanotube, graphite nanofiber, silicon nanowire, and a combination thereof.

A subsidiary cathode electrode metallic layer 24 is further provided between the cathode electrodes 20 and the insulating layer 18. The metallic layer 24 makes it possible to form the electron emission regions 22 using a backside exposure technique, and serves to apply cathode voltages to the electron emission regions 22.

With the formation of the electron emission regions 22, the metallic layer 24 has light transmission portions 24*a* for passing the light for light-exposing the electron emission regions 22. The light transmission portions 24*a* are placed between the linear (vertically long) conductive portions 24*b* arranged in the direction of the gate electrodes 16 (in the Y direction of the drawing) while being spaced apart from each other.

The electron emission region 22 is located at the area of the light transmission portions 24*a* within the receptor 20', and contacts the conductive portions 24*b* to receive the cathode voltages therethrough. Moreover, the electron emission regions 22 maybe arranged within the receptors 20' over the conductive portions 24*b* while contacting the cathode electrodes 20. FIG. 2 illustrates the case where the electron emission regions 22 are arranged within the receptors 20' while contacting the conductive portions 24*b* of the metallic layer 24 and the cathode electrodes 20. The arrangement structure of the electron emission regions 22 is not limited thereto, but may be varied provided that they contact the conductive portions 24*b* of the metallic layer 24.

Turning now to FIGS. 3A through 3E, FIGS. 3A to 3E illustrate variants of the light transmission portions and the conductive portions. FIGS. 3A to 3D illustrate rectangular, circular, triangular and hexagonal dot-typed light transmission portions 20*c*, 20*e*, 20*g* and 20*i* respectively, and conductive portions 20*d*, 20*f*, 20*h* and 20*j* for forming the light transmission portions 20*c*, 20*e*, 20*g* and 20*i*, respectively. That is, with those variants, the light transmission portions 20*c*, 20*e*, 20*g* and 20*i* are formed with a mesh type.

Figure 3A:
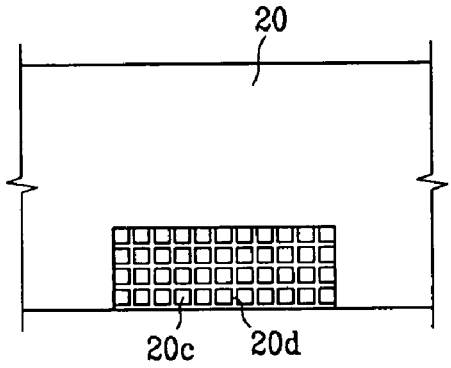
FIGS. 3A to 3E are plan views of variants of light transmission portions and conductive portions for the electron emission device according to the embodiment of the present invention.
Figure 3B:
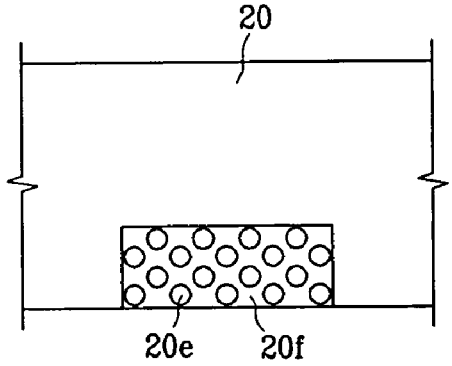
Figure 3C:
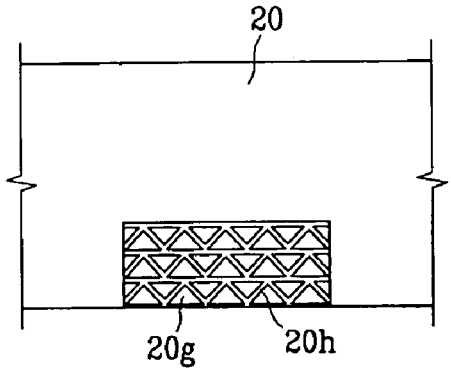
Figure 3D:
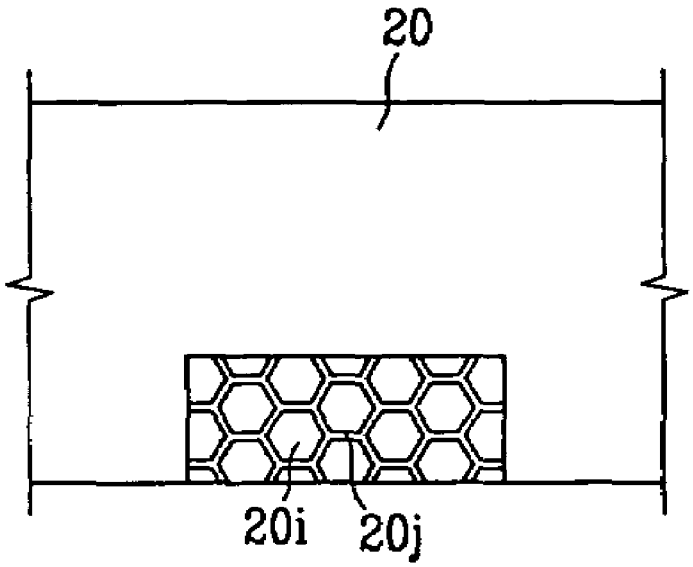
Figure 3E:
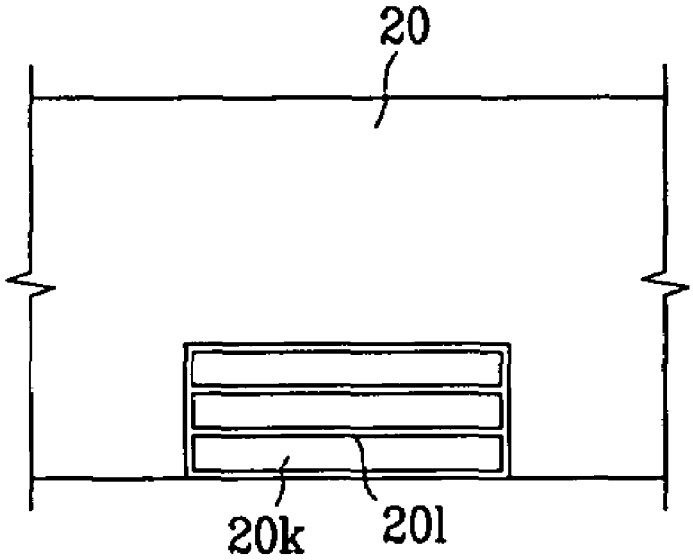

FIG. 3E illustrates light transmission portions 20*k* arranged in the direction of the cathode electrodes 20 (in the X direction of the drawing) and linear (horizontally long) conductive portions 201 for forming the light transmission portions 20*k*. As before, the light transmission portions and the conductive portions may be altered with various shapes.

Meanwhile, the metallic layer 24 and the cathode electrodes 20 are preferably formed with different kinds of metals with etching selectivity. Particularly in this embodiment, the metallic layer 24 contacting the insulating layer 18 is formed with aluminum Al having excellent conductivity, and the cathode electrodes 20 facing the second substrate 14 with chromium Cr having excellent durability.

An anode electrode 26 is formed on the surface of the second substrate 14 facing the first substrate 12, and a phosphor screen 28 is formed on the anode electrode 26 with red, green and blue phosphor layers 28*a* and black layers 28*b*. A metal-based reflective layer, for instance, an aluminum-based reflective layer, may be formed on the phosphor screen 28.

The above-structured electron emission device is driven by applying predetermined voltages to the gate electrodes 16, the cathode electrodes 20 and the anode electrode 26 from the outside. For instance, a positive (+) voltage of several to several tens volts is applied to the gate electrodes 16, a negative (−) voltage of several to several tens volts to the cathode electrodes 20, and a positive (+) voltage of several hundreds to several thousands volts to the anode electrode 26.

Electric fields are formed around the electron emission regions 22 due the voltage difference between the gate and the cathode electrodes 16 and 20, and electrons are emitted from the electron emission regions 22 due to the electric fields. The emitted electrons are attracted toward the phosphor screen 28 by the high voltage applied to the anode electrode 26, and land on the phosphor layers 28*a* at the relevant pixels, thus causing them to emit light to display the desired images.

Figure 4A:
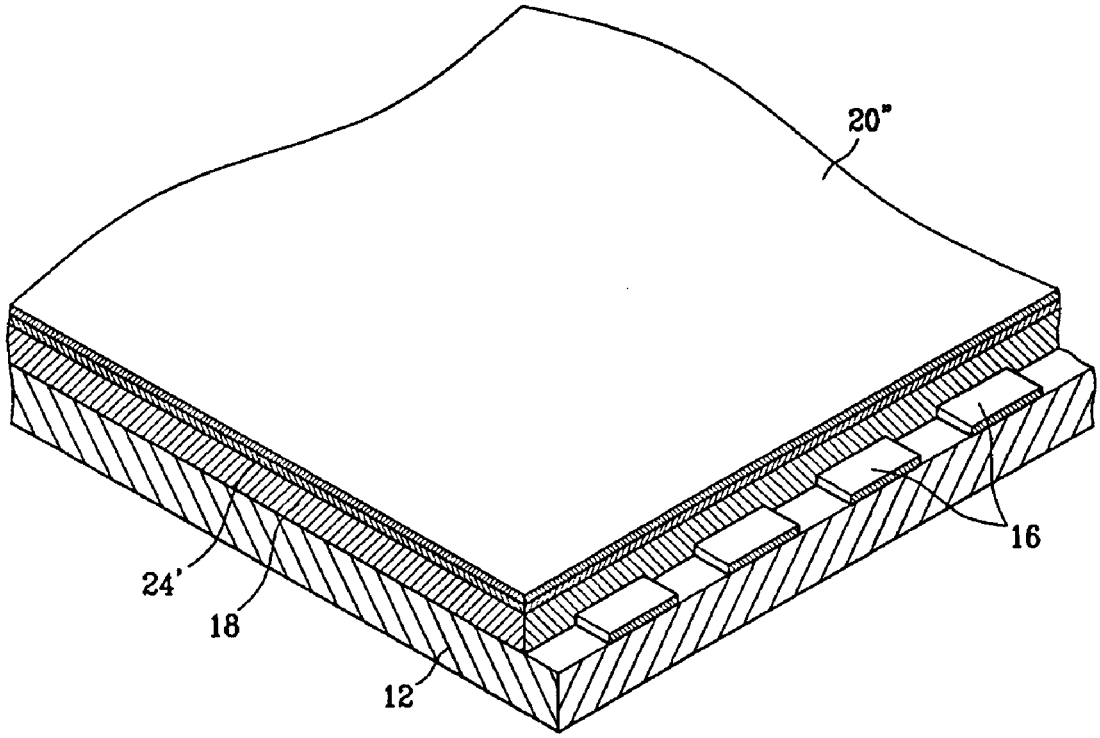
FIGS. 4A to 4E schematically illustrate a method of manufacturing the electron emission device according to the embodiment of the present invention.
Figure 4B:
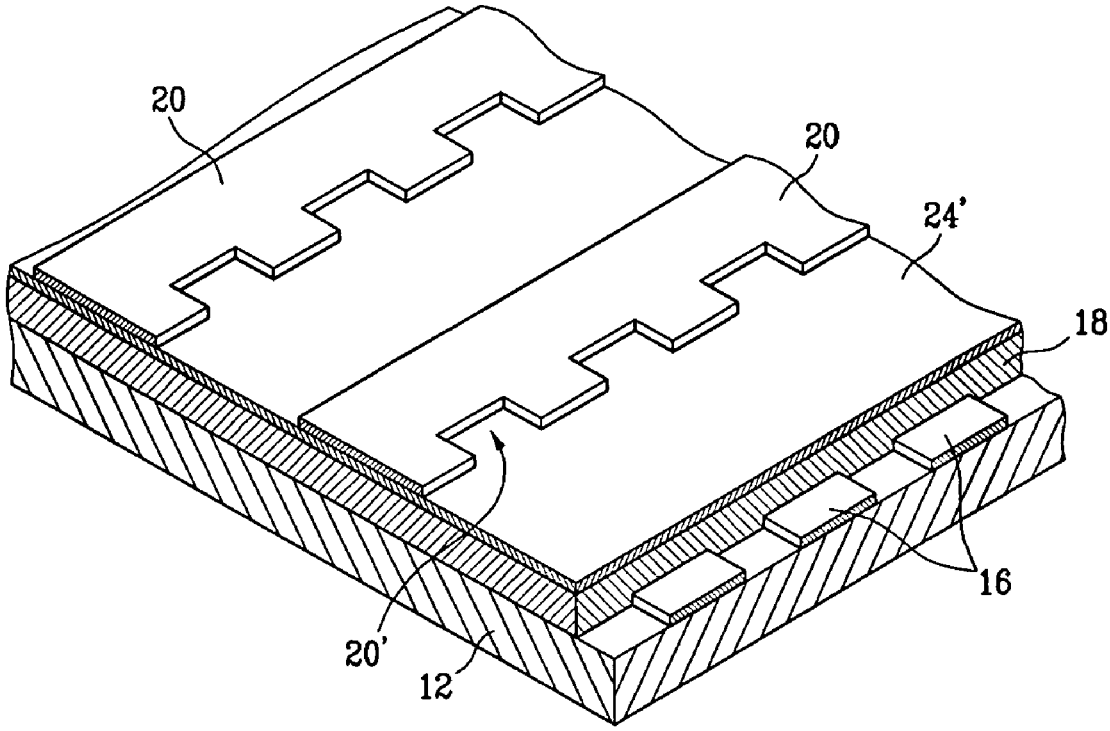
Figure 4C:
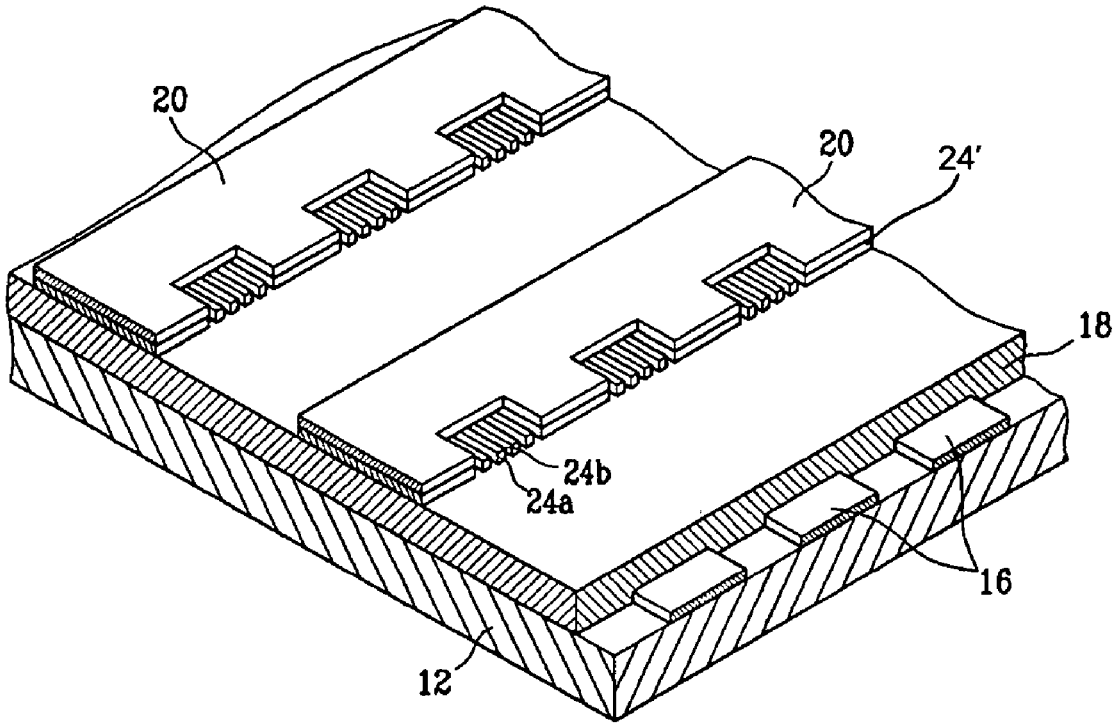

A method of manufacturing the electron emission device will be now explained. Turning now to FIGS. 4A through 4C, FIGS. 4A to 4C illustrate the method of manufacturing the electron emission device.

A transparent conductive material, such as indium tin oxide (ITO), is coated onto the first transparent substrate 12, and is patterned to form stripe-shaped gate electrodes 16. A transparent dielectric material is printed onto the top surface of the first substrate 12 and over the gate electrodes 16, and is dried and is fired to thus form an insulating layer 18. Thereafter, an aluminum Al layer is deposited onto the insulating layer 18 to a thickness of 50-1,000 nm to form a first precursor layer 24' for making the metallic layer 24. A chromium Cr layer is deposited onto the first precursor layer 24' to a thickness of 50-1,000 nm to form a second precursor layer 20" for making the cathode electrodes. As illustrated in FIG. 4A, the first and the second precursor layers 24' and 20" may be formed using a thin film formation process, such as sputtering and dipping.

The second precursor layer 20" is patterned using a mask (not illustrated) and a chromium etchant to form stripe-shaped cathode electrodes 20 proceeding in the direction crossing the gate electrodes 16. At this time, receptors 20' are also simultaneously patterned and formed. As illustrated in FIG. 4B, with the patterning of the second precursor layer 20", the first precursor layer 24' still covers the entire surface of the insulating layer 18, thus preventing the insulating layer 18 from being damaged due to the chromium etchant used to etch the second precursor layer 20".

As illustrated in FIG. 4C, the first precursor layer 24' is patterned using a mask (not illustrated), thus forming light transmission portions 24*a* and conductive portions 24*b* within the receptors 20'. A paste-phased photosensitive electron emission material 22', mainly containing carbon nanotube, is printed onto the cathode electrodes 20 to a large thickness. At this time, the photosensitive electron emission material 22' is placed within the receptors 20', that is, at the light transmission portions 24*a* and the conductive portions 24*b*.

Figure 4D:
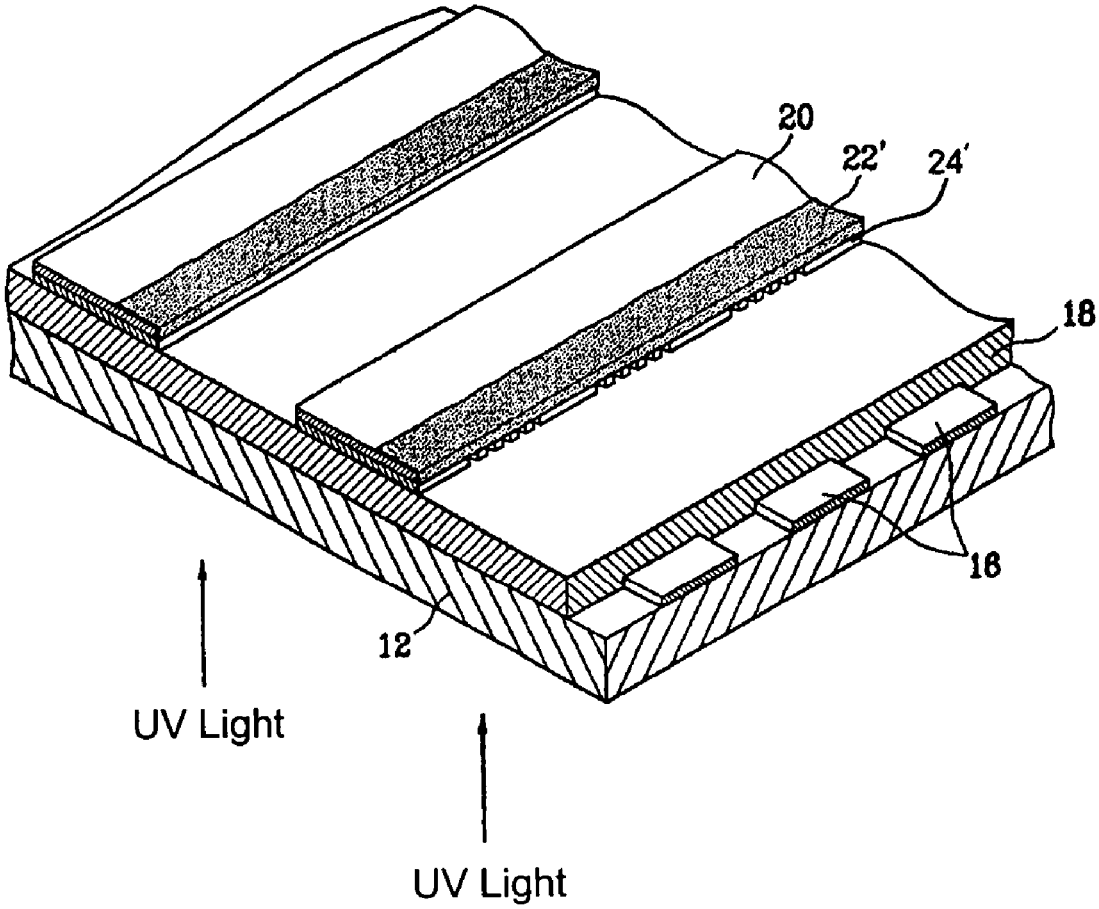
Figure 4E:
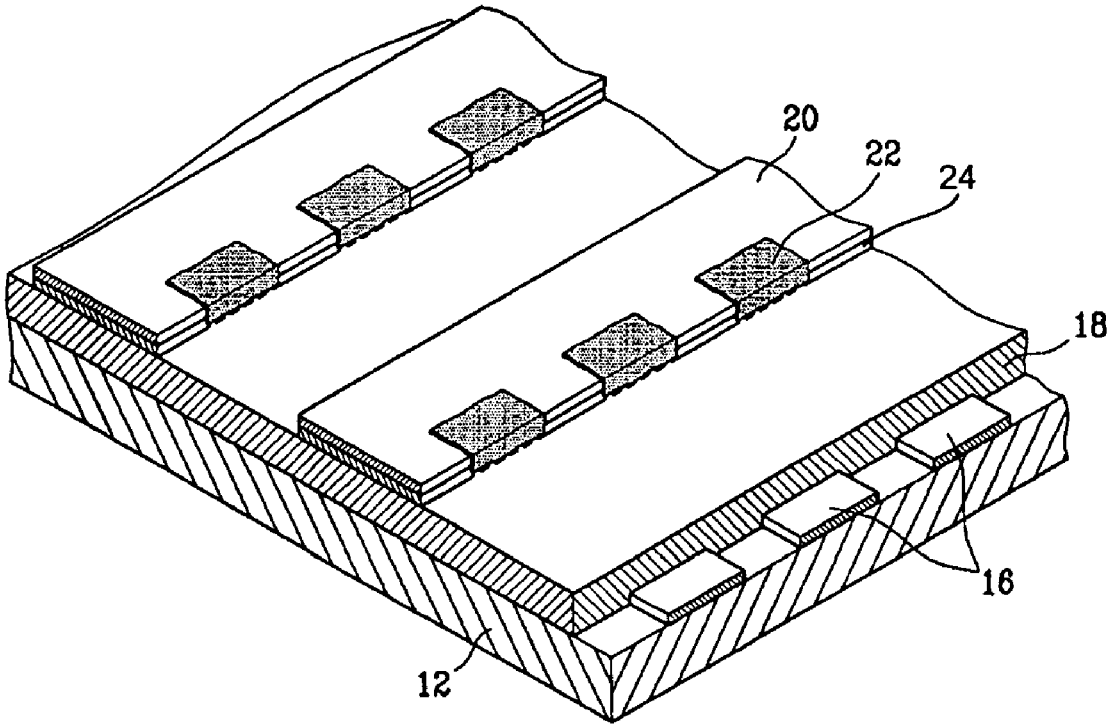

After the printing of the photosensitive electron emission material 22', portions of the photosensitive electron emission material 22' is exposed from the back side using ultraviolet light as illustrated by the arrows in FIG. 4D. During this exposure, metal layer 24 serves as a mask during the exposure. The photosensitive electron emission material 22' placed at the light transmission portions 24*a* is first hardened, and as the ultraviolet illumination degree is reinforced, the electron emission material 22' placed on the conductive portions 24*b* while contacting the cathode electrodes 20 is also hardened. Thereafter, as illustrated in FIG. 4E, the non-hardened electron emission material 22' (i.e., the portions of the electron emission material not exposed by the ultraviolet light because of metal layer 24) as well as the unnecessary portions of the second precursor layer 24' are removed, and electron emission regions 22 with the desired pattern are formed.

Spacers (not illustrated) are mounted onto the first substrate 12, and the first substrate 12 is attached to the second substrate 14 having the anode electrode 26 and the phosphor screen 28 using a sealant (not illustrated). The inner space between the first and the second substrates 12 and 14 is evacuated to thus complete the formation of the electron emission device.

Figure 5:
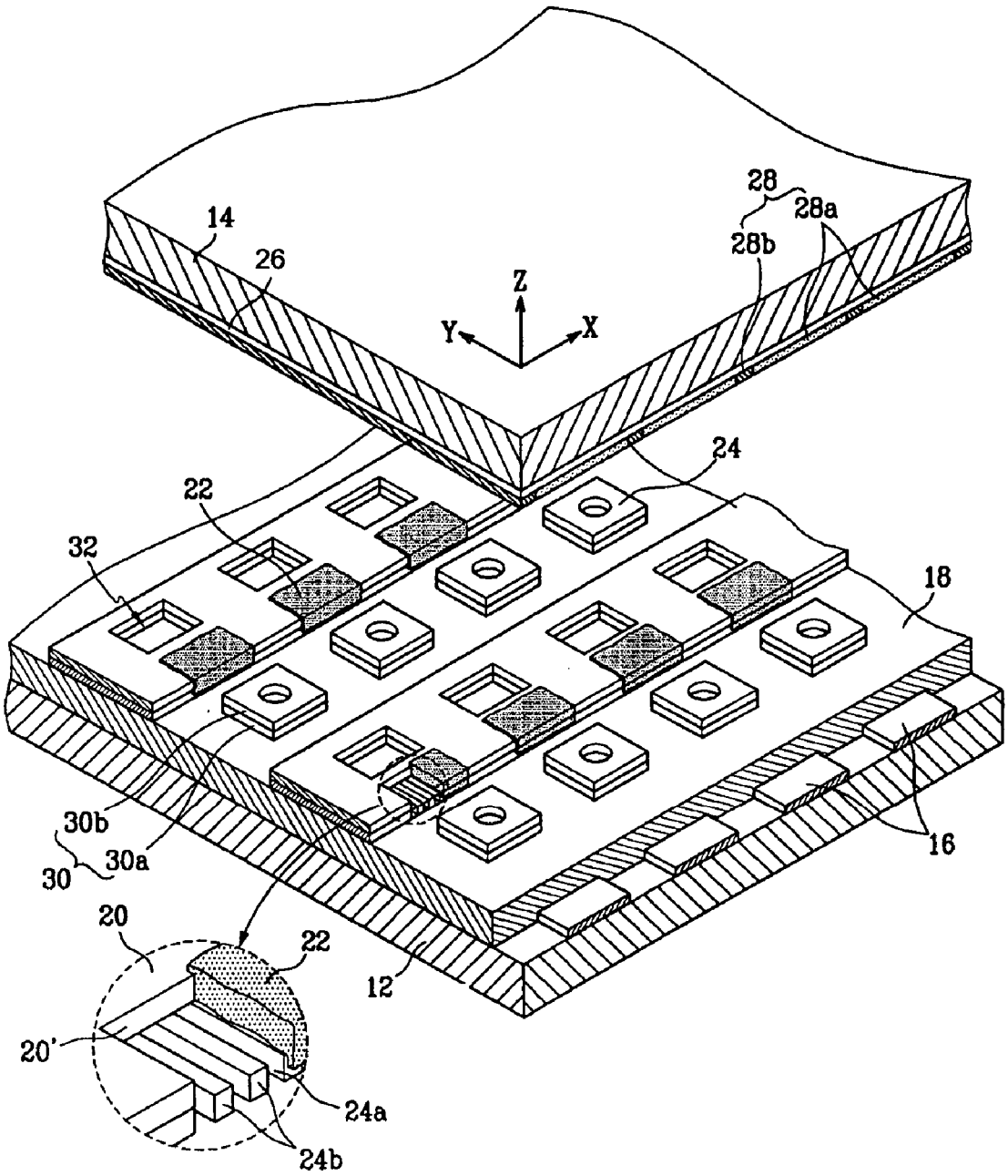
FIG. 5 is a partial exploded perspective view of an electron emission device according to another embodiment of the present invention.

Turning now to FIG. 5, FIG. 5 illustrates a field emission device according to a second embodiment of the present invention. As illustrated in FIG. 5, the electron emission device may further include counter electrodes 30 for pulling up the electric field formed by the gate electrodes 16 over the insulating layer 18. The counter electrodes 30 contact the gate electrodes 16 through holes (not illustrated) formed in the insulating layer 18 while being electrically connected thereto. The counter electrodes 30 are spaced apart from the electron emission regions 22 and between neighboring cathode electrode by a distance.

When predetermined driving voltages are applied to the gate electrodes 16 and the cathode electrodes 20 to form electric fields between them, the counter electrodes 30 make the electric fields diffuse around the electron emission regions 22 such that stronger electric fields are applied to the electron emission regions 22, causing electrons to be better emitted from the electron emission regions 22. As with the cathode electrodes 20, the counter electrodes 30 are laminated with an aluminum-based first layer 30*a* corresponding to the metallic layer 24 and a chromium-based second layer 30*b* corresponding to the cathode electrodes 20.

Furthermore, electric field reinforcing holes 32 are formed within the cathode electrodes 20 in the direction facing the counter electrodes 30 around the electron emission regions 22 by partially removing the cathode electrodes 20 and the metallic layer 24. The holes 32 are operated similar to the counter electrodes 30.

As described above, with the inventive electron emission device, the subsidiary cathode electrode metallic layer 24 prevents the insulating layer 18 from being damaged due to the chromium etchant, thus preventing the generation of cracks on the surface of the insulating layer 18. Accordingly, the diode light emission made due to the remnants of the electron emission material 22 at the cracks of the insulating layer 18 is prevented, thus enhancing the screen image quality.

Furthermore, as the subsidiary cathode electrode metallic layer 24 with an excellent conductivity heightens the conductivity of the cathode electrodes 20, the voltage drop across the cathode electrodes 20 is reduced while increasing the amount of electrons emitted from the electron emission regions 22, thus enhancing the screen brightness while allowing for low driving voltages driving.

In addition, as the electron emission regions 22 are electrically connected to the metallic layer 24 placed under the cathode electrodes 20, the shortcomings made due to the electrical contact failure between the cathode electrodes 20 and the electron emission regions 22 can be removed. As the resistance values of the respective pixels are the same, the distortion in the driving signals due to the electrode resistance is reduced, and the non-uniformity in the amount of charged electrical currents due to the unevenly decreased driving voltage can be removed.

Meanwhile, it is explained that gate electrodes 16 are formed with a stripe pattern, and an anode electrode 30 is formed on the entire inner surface of the second substrate 14. Alternatively, it is possible that a gate electrode 16 is formed on the entire inner surface of the first substrate 12, and anode electrodes 30 are formed with a striped pattern while proceeding in the direction crossing the cathode electrodes 20.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron emission device, comprising:

first and second substrates arranged to face each other;

gate electrodes arranged on the first substrate;

a metallic layer arranged over the gate electrodes with an insulating layer arranged between the metallic layer and the gate electrodes, the metallic layer having light transmission portions;

cathode electrodes arranged on the metallic layer and being electrically connected to the metallic layer; and electron emission region arranged within the light transmission portions of the metallic layer and being electrically connected to the metallic layer.

2. The electron emission device of claim 1, the electron emission region is electrically connected to the cathode electrodes.

3. The electron emission device of claim 1, the light transmission portions comprising minute holes partially formed in the metallic layer.

4. The electron emission device of claim 3, the minute holes having a shape selected from the group consisting of rectangular, circular, triangular and hexagonal dot type.

5. The electron emission device of claim 3, the minute holes being either vertically or horizontally elongated and having a linear shape.

6. The electron emission device of claim 1, the light transmission portions having a mesh pattern.

7. The electron emission device of claim 1, wherein the light transmission portions and the electron emission region are formed at one side of the metallic layer and the cathode electrode in a longitudinal direction of the cathode electrode.

8. The electron emission device of claim 7, the cathode electrode comprises electron emission region receptors at removed portions in the cathode electrode.

9. The electron emission device of claim 8, the electron emission region receptor is formed at the cathode electrode corresponding to a pixel region where the cathode electrode crosses the gate electrode.

10. The electron emission device of claim 1, the metallic layer and the cathode electrode each comprising different kinds of metallic materials having etching selectivity.

11. The electron emission device of claim 10, the metallic layer comprises aluminum Al, the cathode electrode comprises chromium Cr.

12. The electron emission device of claim 1 further comprising counter electrodes arranged on the insulating layer and spaced apart from the electron emission regions by a distance and being electrically connected to the gate electrodes.

13. The electron emission device of claim 12, the counter electrodes comprises a double-layered structure comprising an aluminum layer and a chromium layer.

14. The electron emission device of claim 12, further comprising an electric field reinforcing hole perforating the metallic layer and the cathode electrode and exposing the gate electrode and being arranged opposite to the counter electrode with respect to the electron emission region while being spaced apart from the electron emission region by a distance.

15. An electron emission device, comprising:

first and second substrates arranged to face each other;

gate electrodes arranged on the first substrate;

a transparent insulating layer arranged on the first substrate over the gate electrodes;

a first metallic layer arranged over the insulating layer, the first metallic layer comprising a receptor portion where the first metallic layer is patterned as conductive fingers with gaps therebetween;

a second metallic layer arranged on the first metallic layer; and electron emission region arranged around the conductive fingers and within the gaps therebetween.

16. The electron emission device of claim 15, the first metallic layer being aluminum and the second metallic layer being chromium.

17. The electron emission device of claim 15, the electron emission region comprising carbon nanotubes mixed with a photosensitive material.

18. The electron emission device of claim 15, further comprising:

electric field reinforcing holes perforating the first and the second metallic layers near but separated from the electron emission region; and counter electrodes arranged in the insulating layer and contacting the gate electrodes.

* * * * *